United States Patent [19]

Bohan, Jr.

[11] 4,375,951

[45] Mar. 8, 1983

[54] BILEVEL FLAME SIGNAL SENSING CIRCUIT

[75] Inventor: John E. Bohan, Jr., Minneapolis, Minn.

[73] Assignee: Honeywell Inc., Minneapolis, Minn.

[21] Appl. No.: 179,301

[22] Filed: Aug. 18, 1980

[51] Int. Cl.[3] ..... F23Q 9/08

[52] U.S. Cl. ..... 431/46; 431/25; 431/51; 431/71

[58] Field of Search ..... 431/46, 51, 54, 55, 431/56, 25, 71, 78

[56] References Cited

U.S. PATENT DOCUMENTS

| | | | |
|---|---|---|---|
| 2,260,977 | 10/1941 | Jones . | |
| 2,775,291 | 12/1956 | Wilson . | |
| 3,574,496 | 4/1971 | Hewitt | 431/25 X |
| 3,902,839 | 9/1975 | Matthews | 431/46 |
| 4,087,229 | 5/1978 | Teichert et al. | 431/25 X |
| 4,137,035 | 1/1979 | Cade | 431/46 X |
| 4,197,082 | 4/1980 | Matthews | 431/25 |
| 4,231,732 | 11/1980 | Newport et al. | 431/46 |
| 4,242,079 | 12/1980 | Matthews | 431/46 |
| 4,304,545 | 12/1981 | Matthews | 431/25 |

*Primary Examiner*—Samuel Scott
*Assistant Examiner*—Margaret A. Focarino
*Attorney, Agent, or Firm*—Alfred N. Feldman

[57] ABSTRACT

A fuel burner control system that has a fail safe mode of operation utilizes a flame sensing means that controls two separate signal processing circuits that have two different threshold levels of operation. Each of the signal processing circuits controls a separate switch means and these switch means are interrelated to ensure that a pilot valve and main valve are opened in sequence and that a pilot flame is properly burning before the main valve is opened. If the flame sensing means for the device senses any abnormality, the interrelationship of the output circuits prevents the main valve from opening.

11 Claims, 7 Drawing Figures

BILEVEL FLAME SIGNAL SENSING CIRCUIT

BACKGROUND OF THE INVENTION

In recent years, as an energy conservation measure, the conventional type of pilot and main burner configuration for furnaces and similar equipment has undergone a significant change. For many years it has been conventional to provide a continuous standing pilot which provided a safety function by heating a thermocouple. The thermocouple provided a low power source of energy that had to be present before the main valve could be opened. This type of structure proved to be very safe and very inexpensive to install. The problem with this type of a pilot burner and safety system is that the pilot flame is present day in and day out, even through seasons of the year when the associated heating equipment either has no use or has very limited use. The rise in cost, and the need to conserve fuel has caused a change in the desirability of utilizing a standing pilot. In some states the standing pilot has been legislated out of existence, as an energy conservation measure.

Various approaches have been provided to replace a standing pilot with other types of equipment. One of the most common types of replacements for the standing pilot is a system that utilizes an ignition source such as a spark generator, and further utilizes a conventional flame rod to sense the presence or existence of the pilot flame. This type of system, even though substantially more expensive than a standing pilot, is now necessary in order to conserve gas. This type of a system allows for the ignition of the pilot immediately prior to the pilot actually lighting a main burner. Most of these systems rely on a flame rectification current passing through the pilot flame to verify its existence prior to opening the main valve for the burner. In theory, this type of a system is practical and safe. As a practical matter, however, this type of a system has certain limitations and deficiencies. By providing a flame sensor of the flame rectification type, the main valve of the burner was dependent on a signal that could vary in intensity and in some cases was marginal as far as safety was concerned. A conventional flame rectification system which operated the main valve of the burner was subject to unsafe failures due to fluctuations in the stability of the pilot flame, abnormalities in the ignition source, and in component failure in the electronics of the system.

SUMMARY OF THE INVENTION

The present invention is directed to a fail safe type of fuel burner control system that utilizes a single flame sensor that feeds into electronic circuitry that has two threshold signal levels to identify the status of the flame sensed and to provide a safety function. The two signal levels are processed through two different threshold signal processing circuit means and ultimately control two different switch means which are responsive to the two different threshold signals. The switch means provide interlocking functions that ensure that the fuel burner is started and operated in a safe manner.

In its simplest form, the present invention is directed to a flame rectification sensing system that utilizes two threshold signal processing circuits that in turn control two relays with interlocking contacts. The interlocking contact arrangement ensures that the pilot has been properly ignited and stabilized before the main valve can be opened. The type of ignition source used with this type of device is commonly a silicon controlled relaxation oscillator spark generator, but could be any type of ignition source.

DESCRIPTION OF THE PREFERRED EMBODIMENTS

Figure 1:
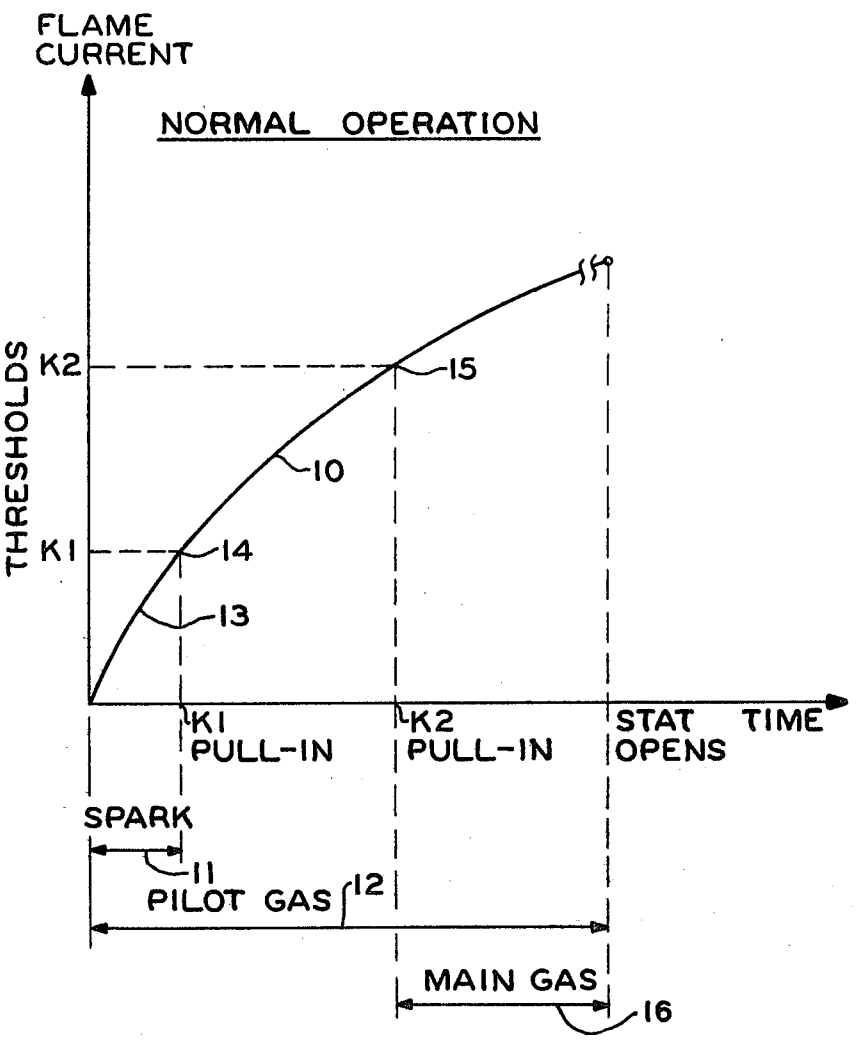
Figure 7:
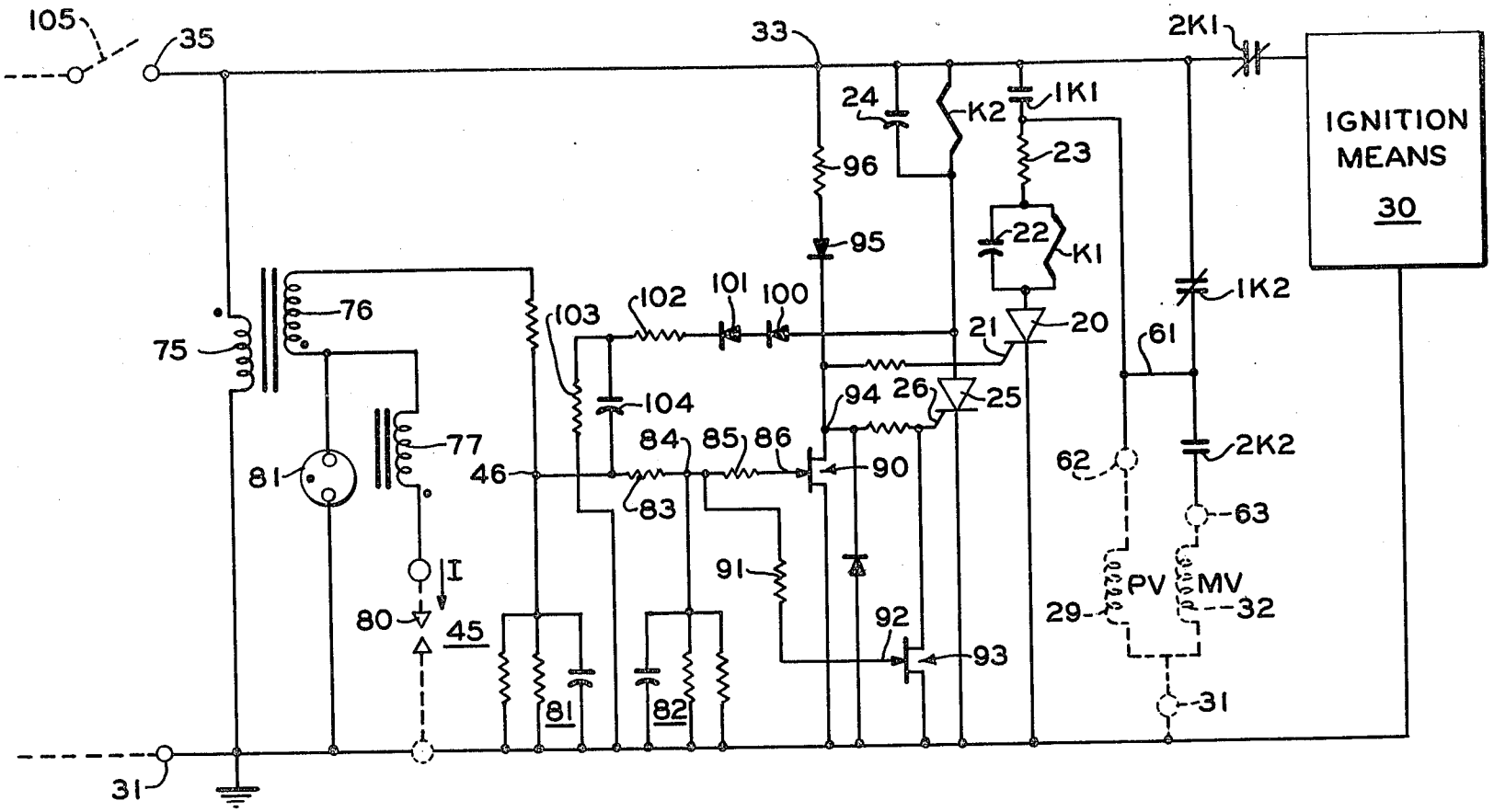
FIG. 7 is a schematic of an actual circuit that corresponds to the block diagram of FIG. 5.

In FIG. 1 there is disclosed a flame current versus time curve for the normal operation of a system or circuit such as is disclosed in detail in FIG. 7. A curve 10 is disclosed which is the normal flame current curve as sensed by a flame sensing means, such as a flame rod, in a flame rectification system. In normal operation, the system would be energized through a control (such as a thermostat) and as indicated along the base of the curve a spark is initiated at 11 along with the opening of a pilot gas supply 12 to generate the portion 13 of the curve 10. At 14, a first relay K1 reaches its threshold of operation and functions to pull in to change relay contacts or switch means. In normal operation, the curve 10 continues to rise until point 15 is reached, at which time a second relay K2 pulls in and energizes a main gas supply disclosed at 16. At this point in time, the system is in normal operation and will remain in operation as long as the relay K2 remains energized keeping the main gas valve supply 16 energized.

Figure 2:
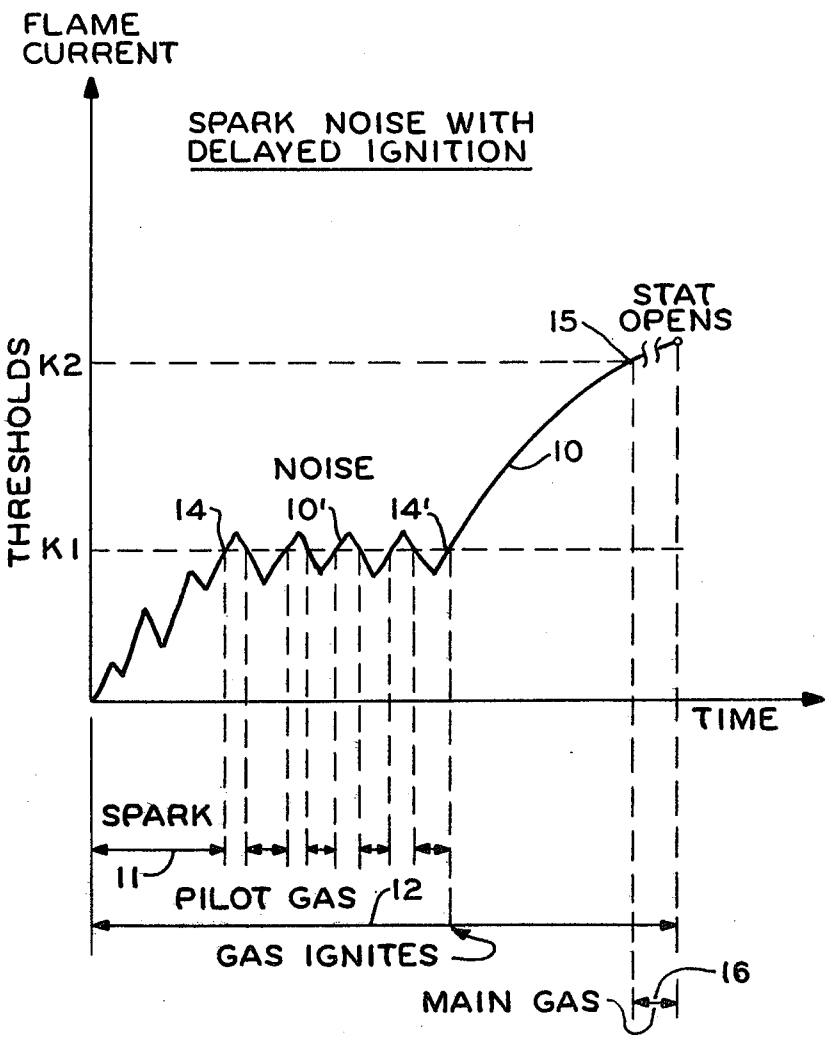
FIGS. 1, 2, and 3 are graphs of a flame current versus the status of the system in a normal, and two abnormal conditions.

In FIG. 2 there is disclosed an abnormal set of circumstances in which the ignition source for the device generates spark noise rather than a clean ignition. This could also be a situation where drafts tend to move the ignition spark or flame with respect to a flame rod. Once again spark 11 is generated and the pilot gas supply 12 is opened. In this case a curve 10' is generated in which the flame current is eradic. The flame current is shown momentarily crossing the threshold 14 of the relay K1 thereby supplying an intermittent source of spark and noise. If the pilot gas ignites and reaches a normal state the curve 10' also reaches a normal state 14', and starts to rise to become the normal curve 10. The curve 10 eventually reaches the threshold of the relay K2 at 15. This allows the main gas supply 16 to become energized. With the arrangement disclosed in FIG. 2, the main gas supply 16 is not permitted to become energized until a stable curve 10 has been established and the threshold level 15 has been reached.

Figure 3:
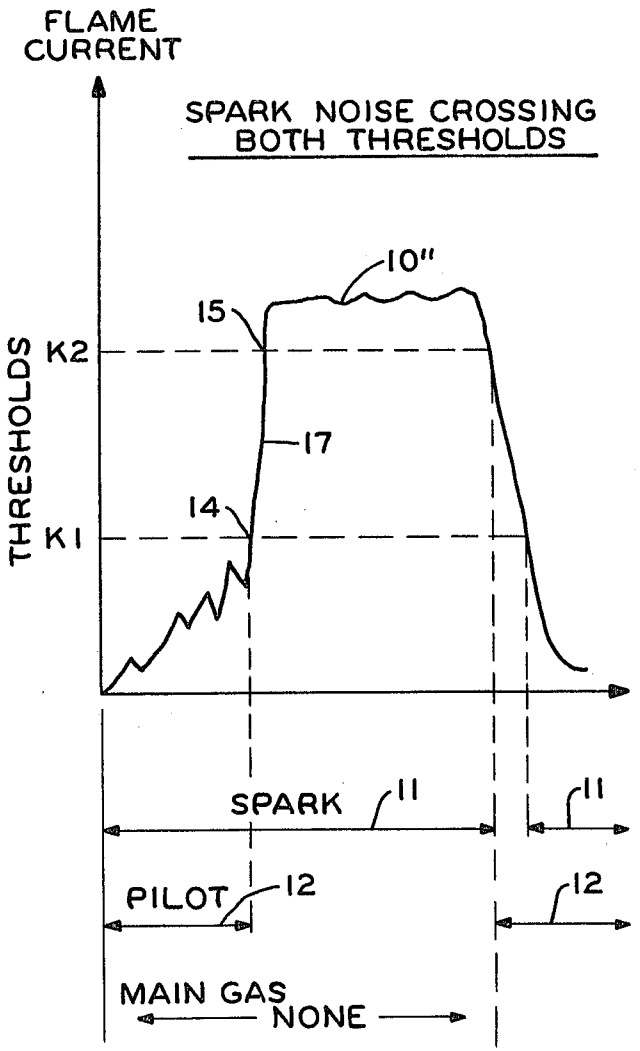

In FIG. 3 there is disclosed an abnormal set of circumstances in which spark noise causes a curve 10'' to be generated wherein the curve rises sharply at 17 to cross the thresholds 14 and 15 almost instantaneously. The rise is very sharp, and due to a very slight time delay in the operation of the relay K1, the relay K1 does not operate and the K1 relay cannot be energized after K2 has become energized. This locks the system out so that while the spark 11 is present there is no gas entering the main burner since the main gas valve will not be permitted to be opened.

Figure 4:
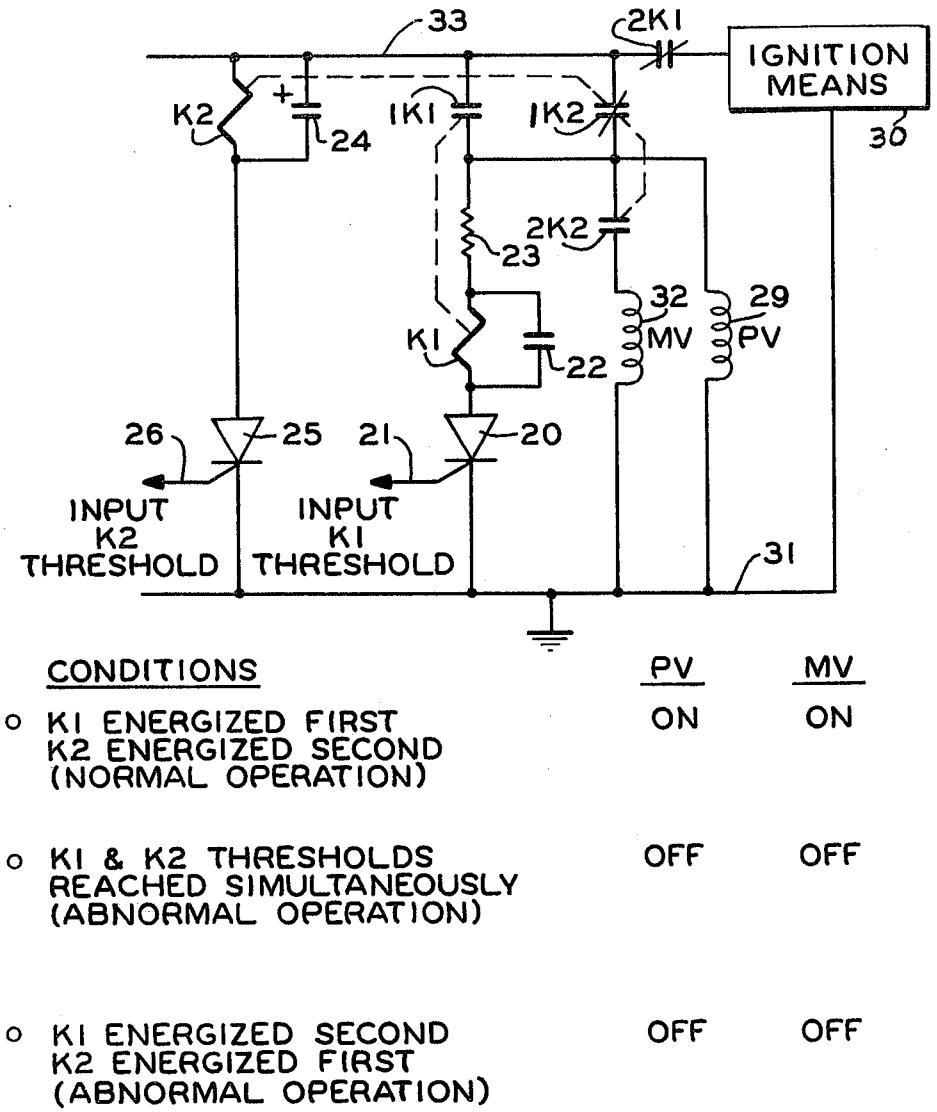
FIG. 4 is a portion of the relay interlock circuitry and a related table.

The means for accomplishing this operation is disclosed in FIG. 4 in a highly simplified version showing only the relay contact interlocking structure. FIG. 4 also sets forth in tabular form the operating conditions showing the status of the various relays and contacts.

Figure 5:
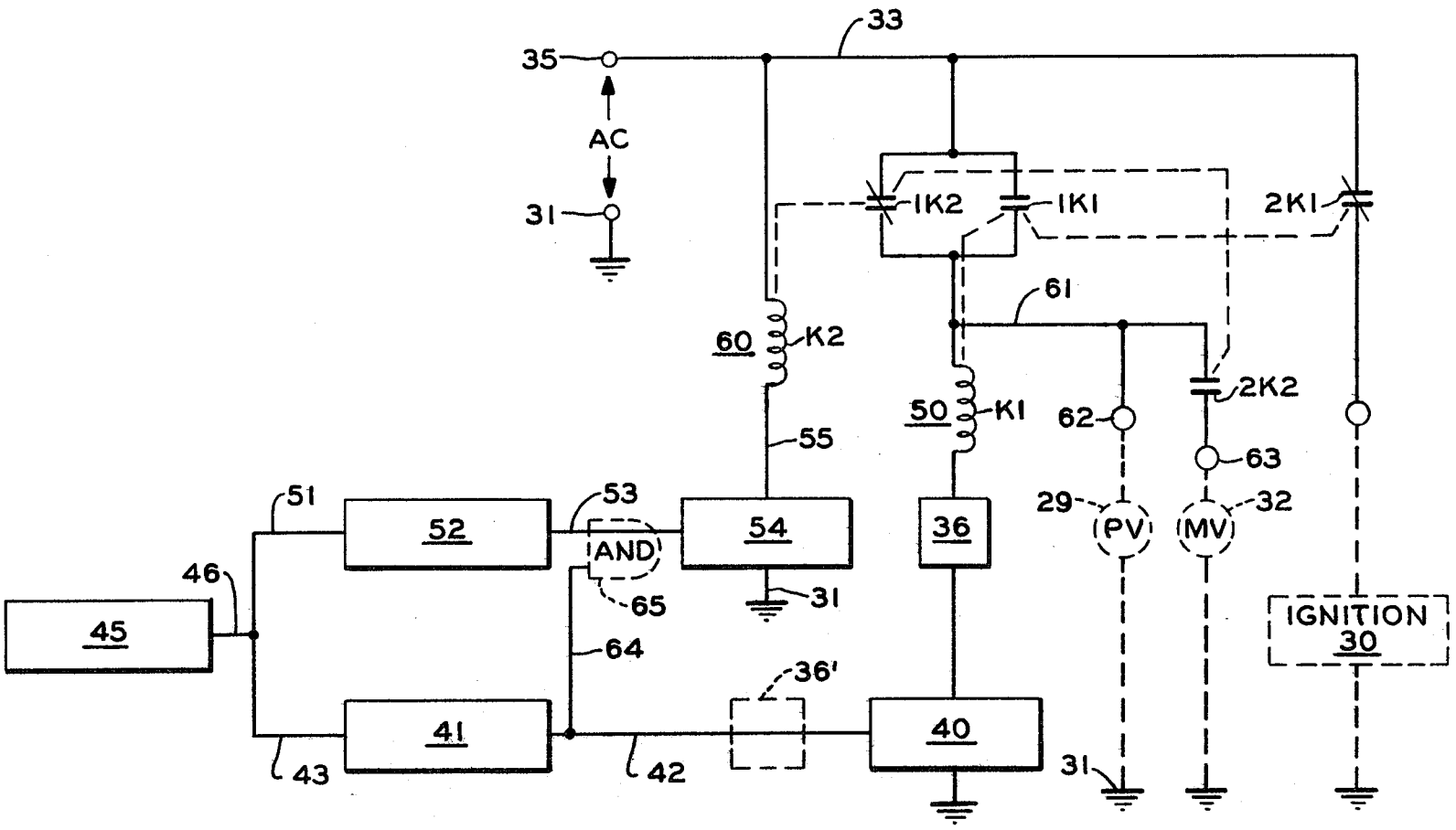
FIG. 5 is a schematic diagram of the invention in a simple system.

In FIG. 4 there is disclosed a portion of the circuit that is disclosed in block form in FIG. 5 and in detail in FIG. 7. The portion of the circuit disclosed in FIG. 4 is the relay portion including the contact structure. A relay K1 is disclosed as energized through a silicon controlled rectifier 20 having a gate means 21 that is connected to a portion of the control circuit that is defined as the first threshold signal processing portion of the circuit. The relay K1 is paralleled by a capacitor 22 in a conventional manner and is connected through a small resistor 23 in order to provide the relay K1 with a very slight time delay in its pull in. The resistor 23 connects to a normally open contact 1K1 of the relay 1K and to a normally closed contact 1K2 of the relay K2. Relay K2 is disclosed as parallel by a capacitor 24 for stable operation of the relay K2. Relay K2 is operated through a second silicon controlled rectifier 25 that has a gate means 26 connected to a second threshold signal processing circuit means that will be disclosed elsewhere. The operating levels for the gates 21 and 26 correspond to the operating points disclosed in FIG. 1 as the first threshold 14 for the relay K1, and at the second threshold 15 for the relay K2.

The relay K1 has a further contact shown as a normally closed contact 2K1 that is used to energize an ignition means 30 that is connected to the contact 2K1 and to a common conductor or ground 31. The ignition means 30 could be a solid state ignitor of the silicon controlled rectifier type that is sometimes referred to as a relaxation oscillator spark ignitor. These are well known types of ignitors. The ignitor also could be a conventional copper-iron type transformer powered ignitor. The only requirement is that the ignition means 30 be energized through the contact 2K1 and that it be capable of igniting the pilot gas for the burner control system. The system disclosed in FIG. 4 is completed by a normally open contact 2K2 of the relay K2 that is connected in an energizing circuit for the main valve disclosed at 32. A pilot valve 29 has been disclosed as paralleling the contact 2K2 and the main valve 32 so that it is energized directly through the normally closed relay contact 1K2 from a conductor 33.

The operation of this portion of the circuit will be briefly explained. Upon the application of power to the conductor 33, the ignition means 30 becomes active and the pilot valve 29 opens through the normally closed relay contact 1K2. This supplies a source of pilot gas and ignition, and as soon as the ignition source is present the signal on the gate means 21 and 26 of the silicon controlled rectifiers 20 and 25 begins to rise along the curve 10 of FIG. 1. As soon as the voltage on the gate means 21 reaches a sufficient point to energize the silicon controlled rectifier 20, the relay K1 pulls in. This is the same as the threshold point 14 on curve 10 of FIG. 1. The action of the relay K1 pulling in immediately closes the contact 1K1 thereby holding the relay K1 into an energized state and opening the contact 2K1 thereby deenergizing the ignition means 30. In normal operation the pilot would be burning and the flame current would be rising along curve 10 of FIG. 1. As soon as the voltage at the gate means 26 reaches the threshold established for that circuit, the silicon controlled rectifier 25 becomes conductive. This is the same as point 15 on curve 10 of FIG. 1. At this point the relay K2 pulls in and energizes the main valve 32 by closing the contact 2K2 which places the system in normal operation.

The normal operation relies on the two threshold levels of operation of the switch means or silicon controlled rectifiers 20 and 25, and the interlocking relationship of the contacts of the two relays K1 and K2. A chart of the various conditions is listed in FIG. 4. The normal conditions have just been described and will not be restated. In the chart of FIG. 4 it is stated that if the relays K1 and K2 reach their threshold simultaneously, which has been designated as an abnormal operation, both the pilot valve 29 and the main valve 32 remain off. This can be understood by realizing that the relay K1 has a slight time delay, and if the relays K1 and K2 reach an operating threshold at the same time the relay K2 will become energized first. This opens the contact 1K2 thereby removing the power which is supplied both to the relay K1 and to the valves 29 and 32. In this case the relay K1 can never become energized and the valves 29 and 32 stay in a deenergized state.

In this third case listed where the relay K2 is energized first and the relay K1 is then energized (again designated as an abnormal operating condition) both of the valves 29 and 32 remain off since the operation of the relay K2 ahead of the relay K1 opens the contact 1K2 and prevents the relay K2 from ever pulling in.

In FIG. 5 there is disclosed a block diagram of a complete fuel burner control system having the fail safe sensing circuit and in which the relay operation has been disclosed. Similar numbers will be used in FIG. 5 to those contained elsewhere in the present disclosure, and the overall fuel burner control system will be described. When alternating current power is supplied to conductor 33 at the terminal 35, such as by the closing of a thermostat (not shown), power is supplied to the conductor 33 and the ground conductor 31. The power is immediately supplied through the normally closed contact 2K1 to the ignition source or means 30, and through the normally closed relay contact 1K2 to the relay K1. The time delay function for relay K1 is shown at 36. The first threshold switch means 40 becomes energized and responsive to an amplifier circuit 41, which is connected to the switch means 40 by the conductor 42 and by the conductor 43 to a flame sensing means 45. The flame sensing means 45 has output means 46 that is connected to the conductor 43. The conductor 43, the amplifier 41, the conductor 42, the switch means 40, the time delay means 36, and the relay K1 along with its associated contacts generally form a first threshold signal processing circuit means for the fuel burner control system. This first threshold signal processing circuit means will be generally identified at 50 for convenience. Also in this circuit, the time delay means 36 could optionally be placed at 36' or elsewhere in the first threshold signal processing circuit means 50.

A second threshold signal processing circuit means is generally disclosed at 60 and includes the conductor 51 that connects to the flame sensing means output circuit means 46. The conductor 51 connects to amplifier means 52 that is connected by conductor 53 to the second threshold switch means 54 that could encompass the silicon controlled rectifier 25 of FIG. 4. The second threshold switch means 54 is connected by conductor 55 to the relay K2 and operates the relay K2 along with its normally closed relay contact 1K2 and its normally open contact 2K2. The conductor 51, the amplifier 52, the conductor 53, and the second threshold switch means 54 along with the conductor 55 and the relay K2 and its associated contacts make up the second threshold signal processing circuit means for the device.

The circuit disclosed in FIG. 5 is completed by a conductor 61 that connects to a terminal 62 that in turn is adapted to be connected to the pilot valve previously disclosed at 29. The conductor 61 further is connected through the normally open relay contact 2K2 to a terminal 63 and to the main valve 32.

OPERATION OF FIG. 5

The operation of FIG. 5 incorporates the relay operation of FIG. 4 and the theory of the operation of the fuel burner control system as a whole. If it is assumed that power is supplied between the terminals 35 and 31, power is immediately supplied through the normally closed relay contact 1K2 to the terminal 62 and to the pilot valve 29 to open the pilot valve. This simultaneously energizes the ignition means 30 through the normally closed relay contact 2K1. In normal operation, a flame would be established at the pilot burner and the flame sensing means 45 would start to generate a flame current signal at its output means 46. The first threshold signal processing circuit means 50 and the second threshold processing circuit means 60 both receive this signal and it is amplified to the switch means 40 and 54. Since the switch means 40 and its associated processing circuit means are set to a lower value of flame current, the relay K1 will become energized after a very short time delay introduced by the time delay means 36. The operation of the relay K1 causes the contact 1K1 to be closed thereby holding in the relay K1 and opening the contact 2K1 to deenergize the ignition source 30. Relay K1 can be controlled by switch means 40. If the pilot remains stable, the flame current will continue to rise along curve 10 of FIG. 1 until the second threshold signal processing circuit means 60 energizes the relay K2 which opens the relay contact 1K2 and closes the relay contact 2K2. The closing of the relay contact 2K2 provides power to the main valve 32 and supplies the main fuel to the burner. The opening of the contact 1K2 is not sensed since the contact 1K1 has closed shunting the contact 1K2.

The normal operation of the system has been disclosed. The system could also encompass a conductor 64 and an AND gate disclosed at 65 to sum the signals of the two signal processing circuit means. This is a feature which would be added but is not essential to the present invention.

In considering the abnormal states of operation, it can be seen that if an abnormal situation disclosed in FIG. 2 occurs that the relay K1 would become energized intermittently, but the relay K2 which controls the flow of the main fuel gas through relay contact 2K2 would not become energized until the flame current curve 10 had reached the second threshold level established at 15 thereby establishing normal operation. In the case of an abnormal operation of FIG. 3, the main valve 32 is never opened because the relay K2 has been allowed to pull in ahead of relay K1.

Figure 6:
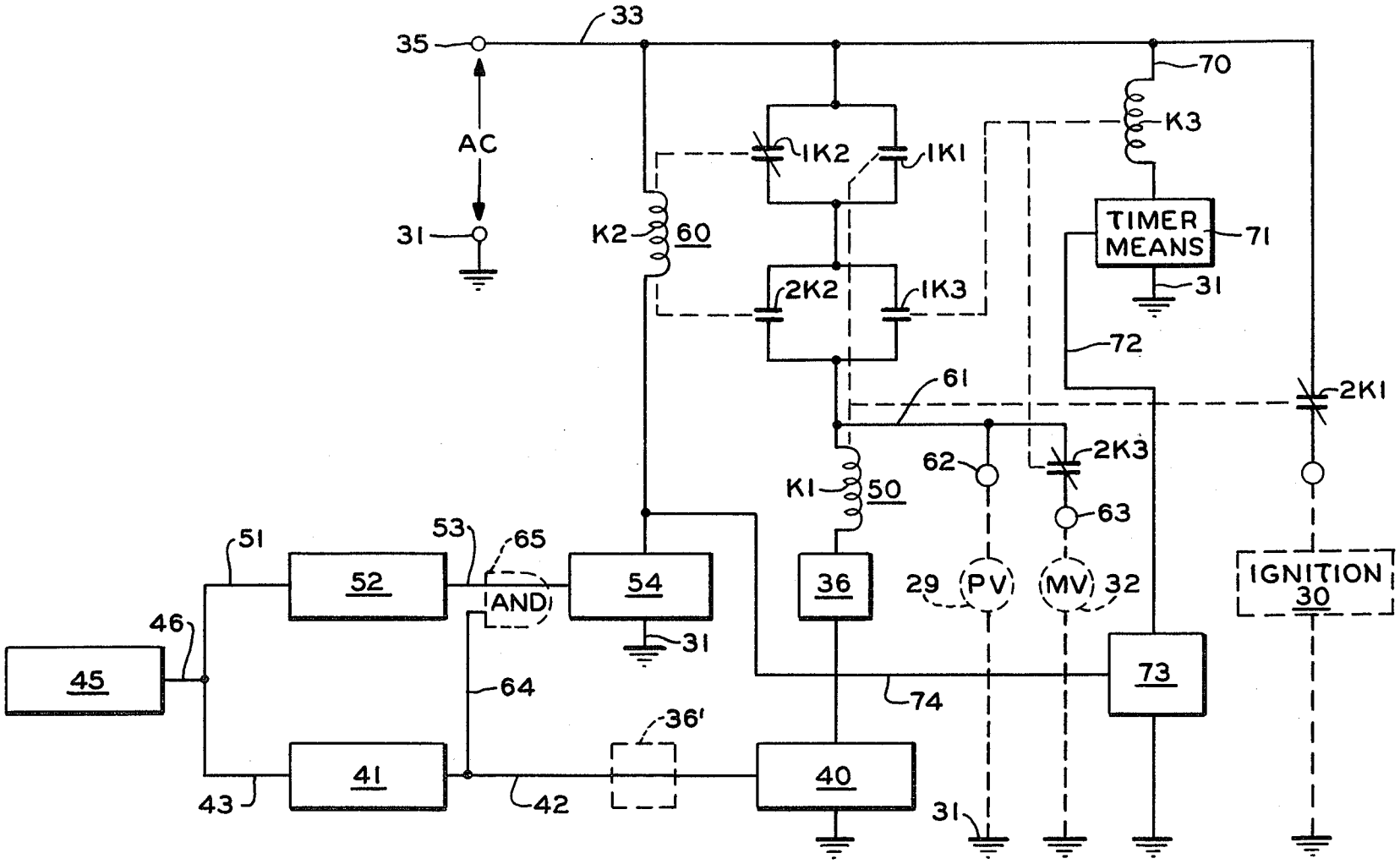
FIG. 6 is a schematic representation of the invention in a more complex system.

In FIG. 6 a circuit which provides for an additional function is disclosed. The same reference numbers will be used in FIG. 6 as in FIG. 5 and only the additional circuit elements will be specifically described. An additional relay K3 is connected by conductor 70 to conductor 33 and is controlled from a timer means 71 that provides a safety timing function. The timer 71 starts to time in a conductive fashion at the beginning of its time interval, but after a set time will deenergize or remove the ground 31 from the relay K3. The timer means 71 is initially energized by conductor 72 that is connected to a third switch means 73 that in turn is controlled by conductor 74 which connects between the relay K2 and the switch means 54 of the second threshold signal processing circuit means 60. The relay K3 has a normally open contact 1K3 in parallel with the contact 2K2, and has a normally closed contact 2K3 in series with the main valve 32 of the fuel burner control system.

OPERATION OF FIG. 6

In FIG. 6 the operation of the basic system is the same as that in FIG. 5 except for the addition of the timer means 71. When power is supplied to the system at terminal 35 voltage is applied to conductor 74 to energize the switch means 73 which starts the timing function of the timer means 71. At this time relay K3 is allowed to be energized by the ground 31 being present and the relay K3 pulls in the normally open contact 1K3 and opens the normally closed contact 2K3. The closing of the contact 1K3 allows power to flow to the first threshold signal processing circuit means 50, but removes any possibility of power being supplied to the main valve 32 by the opening of the contact 2K3. If the system reaches normal operation, as explained in FIG. 5, prior to the time interval set in timer 71, the relay contact 2K2 would close shunting the contact 1K3 and at the same time the conductor 74 is grounded at 31 by the switch means 54 to keep the system in normal operation.

If the system does not reach normal operation by the time the timer means 71 times out, the ground 31 is removed from the relay K3 and the energizing circuit for the first threshold signal processing circuit means 50 is removed by contact 1K3 opening. This causes the system to stop at this point in operation and not restart until the power has been removed from the terminals 35 and 31 and reinstated.

The system disclosed in FIG. 5 is shown in component by component detail in FIG. 7. Only the additional portions of the circuit that were not disclosed in FIG. 5 will be specifically enumerated. In FIG. 7 a transformer primary 75 is disclosed with a secondary 76 and a further secondary 77. The secondary 77 is connected to a flame rod disclosed at 80. The winding 77 and the flame rod 80 are paralleled by a neon tube 81 that prevents high voltage breakdown in the system. Also in this device is a further high voltage winding (not shown) that forms part of the ignition means 30 that supplies a high voltage ignition spark in the flame rod circuit by acting as a primary winding to the secondary winding 77. The details of this type of an ignition and sensing circuit can be found in the Schilling application Ser. No. 59,423 which was filed on July 20, 1979. This circuit provides both an ignition spark generating circuit and a flame rectification sensing circuit which generates a flame rectification signal at the output means junction 46. The only thing that is necessary to know about the circuit just mentioned is that the flame sensor circuit 45 has an output means 46 which is the flame current voltage that has been previously described in FIG. 1 as the curve 10. The output means 46 is connected to a safety circuit 81 and a further safety circuit 82 that are connected together by resistor 83. The safety circuits 81 and 82 are redundant resistance-capacitance circuits that are needed for biasing the voltage at junction 84 and the redundant nature is for safety. The junction 84 is connected through a resistor 85 to the gate 86 of a field effect transistor disclosed at 90, while also being connected through a resistor 91 to the gate 92 of a further field effect transistor generally disclosed at 93. The source-drain circuit of the field effect transistor 90 is connected to the gate means 26 of the silicon controlled rectifier 25 at 94, and this point is further powered through a diode 95 and a resistor 96 which is connected to the conductor 33.

The source-drain circuit of the field effect transistor 93 is connected directly to the gate means 26 of the silicon controlled rectifier 25. It will be noted that the gate means 21 of the silicon controlled rectifier 20 is connected also to the point 94 so that both of the silicon controlled rectifiers 20 and 25 are driven by the same voltage which are in turn controlled by the field effect transistors 90 and 93. The circuit is completed by a circuit that includes a pair of diodes 100 and 101, a resistor 102, a resistor 103 to the ground 33, and a further capacitor 104.

OPERATION OF FIG. 7

The operation of FIG. 7 can be understood if it is assumed that a switch or thermostat means 105 is closed to supply power to the terminal 35. This immediately supplies power to the transformer primary 75 and to the spark ignition means 30. The spark ignition means 30 starts to generate a spark at the flame rectification means 80 that acts also as the sensor. This is a function that can be found in detail in the previously mentioned Schilling application. At this same time power is supplied through the relay contact 1K2, the conductor 61, the terminal 62, and the pilot valve 29 to the ground 31. Under these conditions a spark source is supplied at the flame sensing means 45 and the pilot valve 29 is open. At this same time current is drawn through the diodes 100 and 101 to establish a charge on capacitor 104. This stored charge is later used to cause the main valve switch means to remain "on" for a short period of time upon a momentary indication that the second threshold of the flame amplifier has been reached. At this time both of the field effect transistors 90 and 93 are biased into a conductive state. The field effect transistor 90 directly shorts to ground 31 the gate means 21 of the silicon controlled rectifier 20, while the field effect transistor 93 shorts to ground 31 the gate means 26 of the silicon controlled rectifier 25. A voltage, if operation is normal, immediately becomes negative on the gate 86 of the field effect transistor 90. This field effect transistor is designed to be driven out of conduction in the range of −0.5 to −2.5 volts. The negative voltage at the gate means 86 of the field effect transistor 90 immediately starts to appear from the flame sensor means 45 via the output means 46 and the field effect transistor 90 is driven out of conduction. As soon as the field effect transistor is driven out of conduction, the short on the gate means 21 is removed and the silicon controlled rectifier 20 is driven into conduction by current being drawn through the resistor 96 and the diode 95. This energizes the relay 1K.

As the flame signal continues to rise in a normal fashion, the negative voltage at the output 46 continues to rise and the voltage on the gate 92 of the field effect transistor 93 continues to become more negative. The field effect transistor is driven out of conduction in the range of −3.5 to −5.0 volts. As soon as it is driven out of conduction, the short is removed that it created from the gate means 26 of the silicon controlled rectifier 25 and the silicon controlled rectifier 25 is driven into conduction by current flowing through the resistor 96, the diode 95, and into the gate means 26. This pulls in the relay K2 completing the normal operation of the system.

It can thus be seen that two separate threshold signal processing circuit means have been established to operate the two relays for this device, but that both of the signal processing circuit means are driven by the output means of a single flame sensor.

The circuit that was described in block diagram in FIG. 6 could be implemented by the addition of relatively simple circuitry similar to the type of circuit disclosed in FIG. 7. Any number of variations of the present invention would be readily apparent to anyone skilled in this art. For that reason, the applicant wishes to be limited in the scope of his invention solely by the scope of the appended claims.

The embodiments of the invention in which an exclusive property or right is claimed are defined as follows:

1. A fuel burner control system having a fail safe sensing circuit to insure that a pilot valve has been opened and a pilot flame is established at a pilot burner before a main fuel valve is opened, including: flame sensing means responsive to a flame at said pilot burner with said sensing means having output circuit means; first threshold signal processing circuit means for operation of first threshold switch means; said switch means including normally nonconductive circuit means; second threshold signal processing circuit means for operation of second threshold switch means; said second threshold switch means including normally conductive circuit means and normally nonconductive circuit means; said first and said second threshold signal processing circuit means each being connected to said flame sensing output circuit means; said second threshold conductive switch means connected to initially energize said first threshold switch means and said pilot valve through said normally conductive circuit means; said first threshold circuit means being in an energized state upon said first threshold signal processing circuit means sensing a first flame signal by causing said first threshold normally nonconductive circuit means to become conductive; and said second threshold signal processing circuit means subsequently sensing a second, larger flame signal and opening normally conductive circuit means and closing normally nonconductive circuit means to energize said main fuel valve in a safe manner through the normally nonconductive circuit means of said first threshold conductive switch means.

2. A fuel burner control system as described in claim 1 wherein each of said switch means includes relay means having contact means; said normally nonconductive circuit means being normally open contact means and said normally conductive circuit means being normally closed contact means.

3. A fuel burner control system as described in claim 2 wherein said first threshold signal processing means includes time delay means to provide a time delay in the operation of the first switch means as compared to the time of operation of the switch means for said second signal processing means.

4. A fuel burner control system as described in claim 3 wherein said time delay means is included in said relay means of said first signal processing circuit means.

5. A fuel burner control system as described in claim 4 wherein said first relay means further includes a normally closed ignition contact that is adapted to control an ignition source for said fuel burner.

6. A fuel burner control system as described in claim 4 wherein said first and said second threshold signal processing circuit means each includes a field effect transistor having different operating thresholds; each of said relay means including a silicon controlled rectifier having gate means connected to said field effect transistors to establish the two different levels of threshold operation for said relay means.

7. A fuel burner control system as described in claim 6 wherein said flame sensing means includes a flame rod and a voltage source to detect the presence of flame at said burner by conduction of a current between said burner and said flame rod under the influence of said voltage source.

8. A fuel burner control system as described in claim 7 wherein said first relay means further includes a normally closed ignition contact that is adapted to control an ignition source for said fuel burner.

9. A fuel burner control system as described in claim 4 wherein said second threshold signal processing means includes third switch means operated by said second switch means; said third switch means including timer means having a timer interval, and a lockout relay having normally open and normally closed contacts; said normally open contacts shunting said second contact means normally open contact means and said third switch means normally closed contact to control power to said main valve; said timer means operating said lockout relay to disable said main valve if said second flame signal is not present before said timer interval elapses.

10. A fuel burner control system as described in claim 9 wherein said first relay means further includes a normally closed ignition contact that is adapted to control an ignition source for said fuel burner.

11. A fuel burner control system having a fail safe sensing circuit to insure that a pilot valve has been opened and a pilot flame is established at a pilot burner before a main fuel valve is opened, including: flame sensing means responsive to a flame at said burner with said sensing means having output circuit means; first signal processing circuit means for operation of first switch means; said switch means including normally nonconductive circuit means; second signal processing circuit means for operation of second switch means; said second switch means including normally conductive circuit means and normally nonconductive circuit means; said first and said second signal processing circuit means each being connected to said flame sensing output circuit means; said second conductive switch means connected to initially energize said first switch means and said pilot valve through said normally conductive circuit means; said first circuit means being in an energized state upon said first signal processing circuit means sensing a first flame signal by causing said first normally nonconductive circuit means to become conductive; and said second signal processing circuit means subsequently sensing a second, larger flame signal and opening normally conductive circuit means and closing normally nonconductive circuit means to energize said main fuel valve in a safe manner through the normally nonconductive circuit means of said first conductive switch means.

* * * * *